US010837656B2

(12) United States Patent
Morikawa et al.

(10) Patent No.: US 10,837,656 B2
(45) Date of Patent: Nov. 17, 2020

(54) OUTDOOR UNIT FOR AIR-CONDITIONING APPARATUS

(71) Applicant: Mitsubishi Electric Corporation, Tokyo (JP)

(72) Inventors: Yuudai Morikawa, Tokyo (JP); Yutaka Aoyama, Tokyo (JP); Yu Tamaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 48 days.

(21) Appl. No.: 16/080,518

(22) PCT Filed: May 17, 2016

(86) PCT No.: PCT/JP2016/064622

§ 371 (c)(1),
(2) Date: Aug. 28, 2018

(87) PCT Pub. No.: WO2017/199339

PCT Pub. Date: Nov. 23, 2017

(65) Prior Publication Data

US 2019/0072285 A1 Mar. 7, 2019

(51) Int. Cl.
*F24F 1/16* (2011.01)
*F24F 1/18* (2011.01)
(Continued)

(52) U.S. Cl.
CPC ..... *F24F 1/16* (2013.01); *F24F 1/18* (2013.01); *F24F 1/50* (2013.01); *F24F 1/56* (2013.01);
(Continued)

(58) Field of Classification Search
CPC ..... F24F 13/30; F24F 1/50
See application file for complete search history.

(56) References Cited

U.S. PATENT DOCUMENTS 5,878,596 A 3/1999 Shimotani et al.
2002/0134099 A1 9/2002 Mochizuki et al.
(Continued)

FOREIGN PATENT DOCUMENTS

CN 102679463 A 9/2012
EP 2354683 A2 * 8/2011 ..... F24F 1/16
(Continued)

OTHER PUBLICATIONS

Extended European Search Report dated Apr. 9, 2019 issued in corresponding EP patent application No. 16902359.5.
(Continued)

*Primary Examiner* — Filip Zec
(74) *Attorney, Agent, or Firm* — Posz Law Group, PLC

(57) ABSTRACT

An outdoor unit for an air-conditioning apparatus is provided in which heat-exchanger units can be arranged such that a heat exchanger has a further increased capacity in a casing of a limited size while the volume of air to be fed to the heat exchanger is maximized. An outdoor unit for an air-conditioning apparatus includes a casing having a rectangular plan-view shape formed of a front portion, a left portion, and a rear portion; a heat exchanger provided in the casing and including a plurality of parts each having a rectangular plan-view shape; and a plurality of air-sending fans provided above a plurality of air inlet spaces, respectively, the air inlet spaces each being provided on an inner side of a corresponding one of the plurality of rectangular parts of the heat exchanger.

12 Claims, 7 Drawing Sheets

(51) Int. Cl.

| | |
|---|---|
| ***F24F 1/50*** | (2011.01) |
| ***F24F 1/56*** | (2011.01) |
| ***F24F 13/20*** | (2006.01) |
| ***F24F 13/30*** | (2006.01) |
| *F24F 13/08* | (2006.01) |
| *F24F 13/24* | (2006.01) |

(52) U.S. Cl.
CPC ..... *F24F 13/20* (2013.01); *F24F 13/30* (2013.01); *F24F 13/082* (2013.01); *F24F 13/24* (2013.01)

(56) References Cited

U.S. PATENT DOCUMENTS

| | | | | |
|---|---|---|---|---|
| 2007/0163295 | A1* | 7/2007 | Martin, Sr. ..... | F24F 1/08 62/507 |
| 2009/0084131 | A1* | 4/2009 | Reifel ..... | F24F 1/18 62/515 |
| 2014/0047857 | A1* | 2/2014 | Sao ..... | F24F 1/24 62/259.2 |
| 2014/0196874 | A1* | 7/2014 | Miyake ..... | F24F 1/16 165/121 |

FOREIGN PATENT DOCUMENTS

| | | | |
|---|---|---|---|
| JP | H09-229422 | A | 9/1997 |
| JP | 2001-201108 | A | 7/2001 |
| JP | 2003-232541 | A | 8/2003 |
| JP | 2003-240275 | A | 8/2003 |
| JP | 2003-240276 | A | 8/2003 |
| JP | 2003-254565 | A | 9/2003 |
| JP | 2003-279076 | A | 10/2003 |
| JP | 2008-282068 | A | 12/2008 |
| WO | 2013/098872 | A | 7/2013 |
| WO | 2014/054111 | A1 | 4/2014 |

OTHER PUBLICATIONS

Office Action dated Jul. 30, 2019 issued in corresponding JP patent application No. 2018-517972 (and English translation).
International Search Report of the International Searching Authority dated Aug. 9, 2016 for the corresponding international application No. PCT/JP2016/064622 (and English translation).
Office Action dated Mar. 19, 2020 issued in corresponding CN patent application No. 201680085623.0 (and English translation).
Office Action dated Apr. 22, 2020 issued in corresponding European patent application No. 16902359.5.
Office Action dated Sep. 18, 2020 issued in corresponding CN patent application No. 201680085623.0 (and English translation).

* cited by examiner

OUTDOOR UNIT FOR AIR-CONDITIONING APPARATUS

CROSS REFERENCE TO RELATED APPLICATION

This application is a U.S. national stage application of PCT/JP2016/064622 filed on May 17, 2016, the contents of which are incorporated herein by reference.

TECHNICAL FIELD

The present invention relates to an outdoor unit for an air-conditioning apparatus that includes a heat exchanger including a plurality of heat-exchanger units provided in a casing, and a plurality of air-sending fans provided at the top of the casing.

BACKGROUND ART

In recent years, in view of reduction in power consumption, there have been demands for higher power-saving performance of outdoor units to be included in air-conditioning apparatuses installed in buildings such as high-rises and commercial facilities.

To improve cooling capacity and heating capacity, there have also been demands for greater-capacity heat exchangers of outdoor units to be included in air-conditioning apparatuses.

Accordingly, outdoor units for such air-conditioning apparatuses need to have greater-capacity heat exchangers provided in casings of limited sizes with maximized volume of air to be fed to the heat exchangers while satisfying the demands for higher power-saving performance.

In a prior-art outdoor unit for an air-conditioning apparatus, heat exchangers are provided on the rear side, the left side, and the right side, respectively, and an air-sending fan is provided at the top of a casing of the outdoor unit. When the air-sending fan is activated, a negative pressure is generated in the casing provided below the air-sending fan. With the negative pressure, air around the outdoor unit is taken into the casing. Then, heat is exchanged between the air taken into the casing and refrigerant flowing in the heat exchangers.

The heat exchangers each include a stack of fins arranged at intervals, and a heat-exchanger tube orthogonally passing through the fins. The heat-exchanger tube is a circular tube, for example. As refrigerant flows in the circular tube, the fins radiates heat received from the circular tube. While this is an exemplary case where the heat-exchanger tube is a circular tube, the heat-exchanger tube may alternatively be a flat tube, for example.

As examples of the above prior-art outdoor unit for an air-conditioning apparatus, there are some known structures in each of which a lower part of the casing serves as a machine chamber, an upper part of the casing serves as a heat-exchanger chamber, and heat exchangers are present on four sides of the casing, which has a rectangular shape in plan view (see Patent Literature 1 to 3, for example).

In each of the techniques disclosed by Patent Literature 1 to 3, an air-sending fan is provided above the heat-exchanger chamber of the casing so that a maximum volume of air can be fed to the heat exchangers. The number of air-sending fans provided at the top of the casing may be plural.

In the technique disclosed by Patent Literature 1, two L-shaped heat-exchanger units each including a front portion or a rear portion and a left portion or a right portion are provided on the front and the rear sides, respectively, of a casing, whereby either of the heat exchangers is present on the four sides of the casing, which has a rectangular plan-view shape.

In the technique disclosed by Patent Literature 2, a U-shaped heat-exchanger unit having a rear portion, a left portion, and a right portion is provided on the rear side of a casing, and a flat heat-exchanger unit is provided on the front side, whereby either of the heat exchangers is present on the four sides of the casing, which has a rectangular plan-view shape. The U-shaped heat-exchanger unit provided on the rear side extends to reach a metal sheet provided at the bottom of the outdoor unit.

In the technique disclosed by Patent Literature 3, U-shaped heat-exchanger units each including a front portion, a rear portion, and a left portion or a right portion are provided on the left and right sides, respectively, of a casing, whereby either of the heat exchangers is present on the four sides of the casing, which has a rectangular plan-view shape.

CITATION LIST

Patent Literature

Patent Literature 1: Japanese Unexamined Patent Application Publication No. 2003-240276

Patent Literature 2: Japanese Unexamined Patent Application Publication No. 2003-254565

Patent Literature 3: Japanese Unexamined Patent Application Publication No. 2003-232541

SUMMARY OF INVENTION

Technical Problem

The arrangements of the heat-exchanger units in the respective techniques disclosed by Patent Literature 1 to 3 all allow air to be taken in from four sides, that is, the front, left, right, and rear sides, around the air-sending fan. Therefore, drift currents are less likely to occur in these outdoor units for air-conditioning apparatuses. Such an arrangement contributes to a reduction in the noise generated by the air-sending fan or a reduction in the power to be inputted to the air-sending fan.

Note that the heat exchanger is present on the front, left, right, and rear sides of the casing having a rectangular plan-view shape. Considering further increase in the capacity of the heat exchanger along with maximization of the volume of air to be fed to the heat exchanger, such an arrangement of heat-exchanger units tends to be restricted in terms of the width and the depth of the casing.

The present invention is to solve the above problem and provides an outdoor unit for an air-conditioning apparatus in which heat-exchanger units can be arranged such that a heat exchanger has a further increased capacity in a casing of a limited size while the volume of air to be fed to the heat exchanger is maximized.

Solution to Problem

An outdoor unit for an air-conditioning apparatus according to an embodiment of the present invention includes a casing having a rectangular plan-view shape formed of a front portion, a left portion provided on a side of the front portion, a right portion provided opposite the left portion, and a rear portion provided opposite the front portion; a heat exchanger provided in the casing and including a plurality of parts each having a rectangular plan-view shape with side faces being present on a front side, a left side, a right side, and a rear side, respectively, of the casing; and a plurality of air-sending fans provided above a plurality of air inlet spaces, respectively, the air inlet spaces each being provided on an inner side of a corresponding one of the plurality of rectangular parts of the heat exchanger.

Advantageous Effects of Invention

In the outdoor unit for an air-conditioning apparatus according to the above embodiment of the present invention, the heat exchanger including the plurality of parts each having the rectangular plan-view shape with the side faces being present on the front side, the left side, the right side, and the rear side, respectively, of the casing is provided in the casing. Therefore, the heat-exchanger units can be arranged such that the heat exchanger has a further increased capacity in the casing of a limited size while the volume of air to be fed to the heat exchanger is maximized.

DESCRIPTION OF EMBODIMENTS

Figure 1:
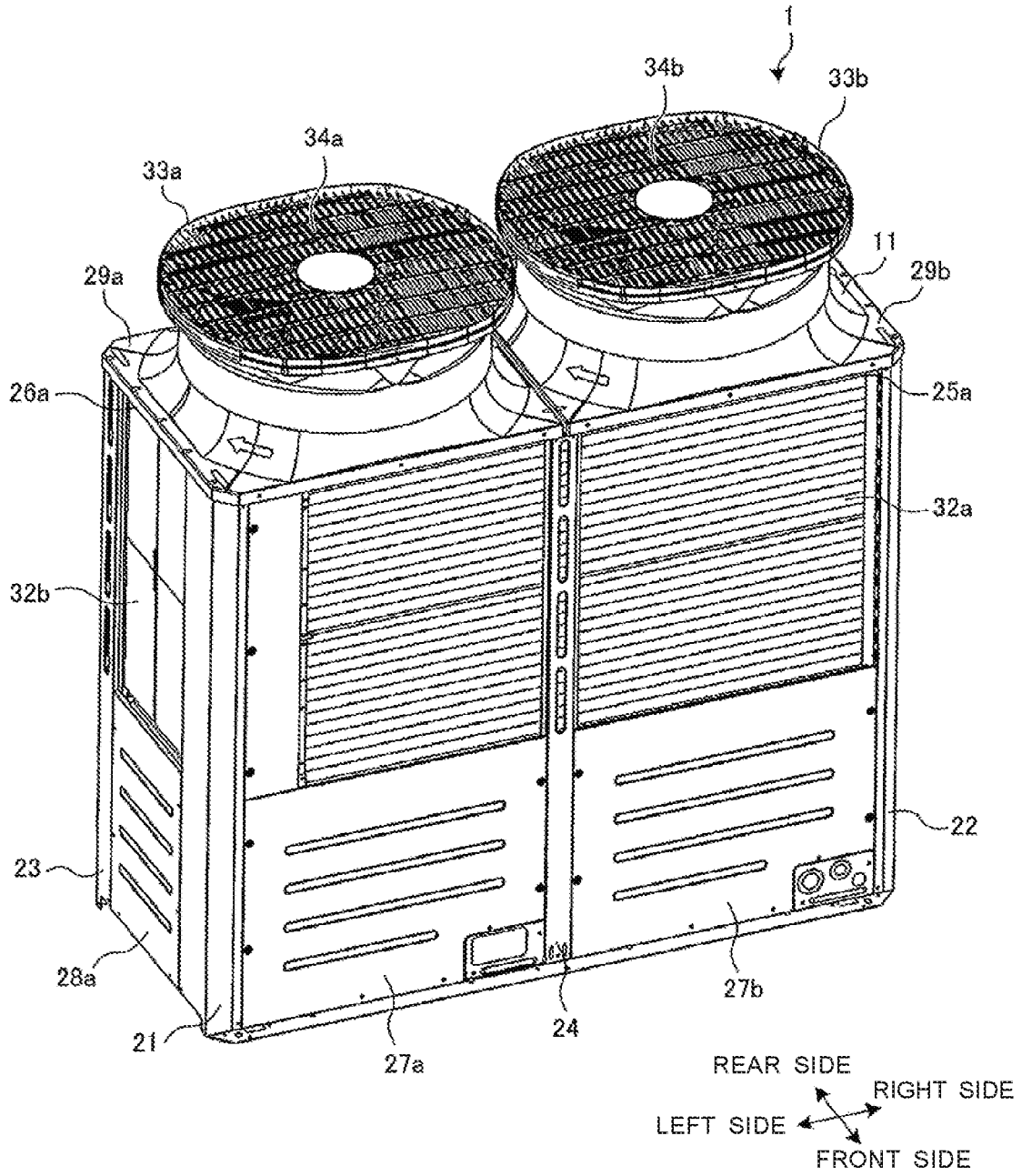
FIG. 1 is a perspective view of an outdoor unit for an air-conditioning apparatus according to Embodiment 1 of the present invention.

Embodiments of an outdoor unit for an air conditioning apparatus according to the present invention will now be described with reference to the drawings. The illustration in the drawings is only exemplary and does not limit the present invention. In the drawings, like reference numerals denote like or corresponding elements, which also applies to the entirety of this specification. The drawings are not necessarily to scale.

Embodiment 1

[Configuration of Outdoor Unit for Air-Conditioning Apparatus]

FIG. 1 is a perspective view of an outdoor unit 1 for an air-conditioning apparatus according to Embodiment 1 of the present invention.

As illustrated in FIG. 1, the outdoor unit 1 includes a casing 11 on an outer periphery thereof. The casing 11 includes a front portion facing frontward, a left portion provided on a side of the front portion, a right portion provided on another side of the front portion and opposite the left portion, and a rear portion provided opposite the front portion. The casing 11 has a rectangular shape in plan view.

The casing 11 is provided with a left front pillar 21 at a left front corner thereof in front view. The casing 11 is further provided with a left rear pillar 23 at another corner thereof on the rear side of the left front pillar 21 in front view. The casing 11 is further provided with a right front pillar 22 at a right front corner thereof in front view. The casing 11 is further provided with a right rear pillar, not illustrated, at yet another corner thereof on the rear side of the right front pillar 22 in front view. The casing 11 is further provided with a front center pillar 24 at the front center thereof. The casing 11 is further provided with a rear center pillar, not illustrated, at the rear center thereof.

The left front pillar 21 and the right front pillar 22 are bridged by a front frame 25*a* at the upper ends thereof. The left front pillar 21 and the left rear pillar 23 are bridged by a left frame 26*a* at the upper ends thereof. The right front pillar 22 and the right rear pillar are bridged by a right frame, not illustrated, at the upper ends thereof. The left rear pillar 23 and the right rear pillar are bridged by a rear frame, not illustrated, at the upper ends thereof.

The casing 11 includes lower front panels 27*a* and 27*b* at the lower front thereof. The lower front panels 27*a* and 27*b* are removable or openable/closable. The lower front panels 27*a* and 27*b* are removed or opened/closed when, for example, a worker maintains components provided in the casing 11.

The casing 11 further includes a lower left panel 28*a* at the lower left thereof. The casing 11 further includes a lower right panel, not illustrated, at the lower right thereof. The casing 11 further includes a lower rear panel, not illustrated, at the lower rear thereof. The lower left panel 28*a*, the lower right panel, and the lower rear panel may also be removable or openable/closable, as with the lower front panels 27*a* and 27*b*. In that case, the lower left panel 28*a*, the lower right panel, and the lower rear panel are removable or openable/closable when, for example, a worker maintains components provided in the casing 11.

The casing 11 has air inlets 32*a* and 32*b* in the front portion, the left portion, the right portion, and the rear portion, respectively, forming the rectangular plan-view shape. Air is taken into the casing 11 from the air inlets 32*a* and 32*b*. The air inlet 32*a* provided in the front portion of the casing 11 is surrounded by the left front pillar 21, the right front pillar 22, the front frame 25*a*, and the lower front panels 27*a* and 27*b*. The air inlet 32*b* provided in the left portion of the casing 11 is surrounded by the left front pillar 21, the left rear pillar 23, the left frame 26*a*, and the lower left panel 28*a*. Likewise, the air inlets, not illustrated, are provided in the right portion and the rear portion, respectively, of the casing 11.

The casing 11 includes two top panels 29*a* and 29*b* provided at the top thereof. The top panel 29*a* has an air outlet 33*a* as an opening port for blowing air therefrom. The top panel 29*b* has an air outlet 33*b* as an opening port for blowing air therefrom. The casing 11 is provided with two air-sending fans 34*a* and 34*b* at the top thereof. The two air-sending fans 34*a* and 34*b* are arranged in parallel at the top of the casing 11. The air-sending fan 34*a* is provided below the air outlet 33*a*. The air-sending fan 34*b* is provided below the air outlet 33*b*.

When the two air-sending fans 34*a* and 34*b* are activated, a negative pressure is generated in the casing 11. Accordingly, air is taken in from the air inlets 32*a* and 32*b* provided in the four sides, that is, the front portion, the left portion, the right portion, and the rear portion, of the casing 11. The air thus taken into the casing 11 is blown out by the two air-sending fans 34*a* and 34*b* from the two air outlets 33*a* and 33*b*.

While the casing 11 of the outdoor unit 1 for an air-conditioning apparatus according to Embodiment 1 has been described above, the present invention is not limited to such an embodiment. The configuration may be changed according to need. For example, another member may be added to the casing 11.

Figure 2:
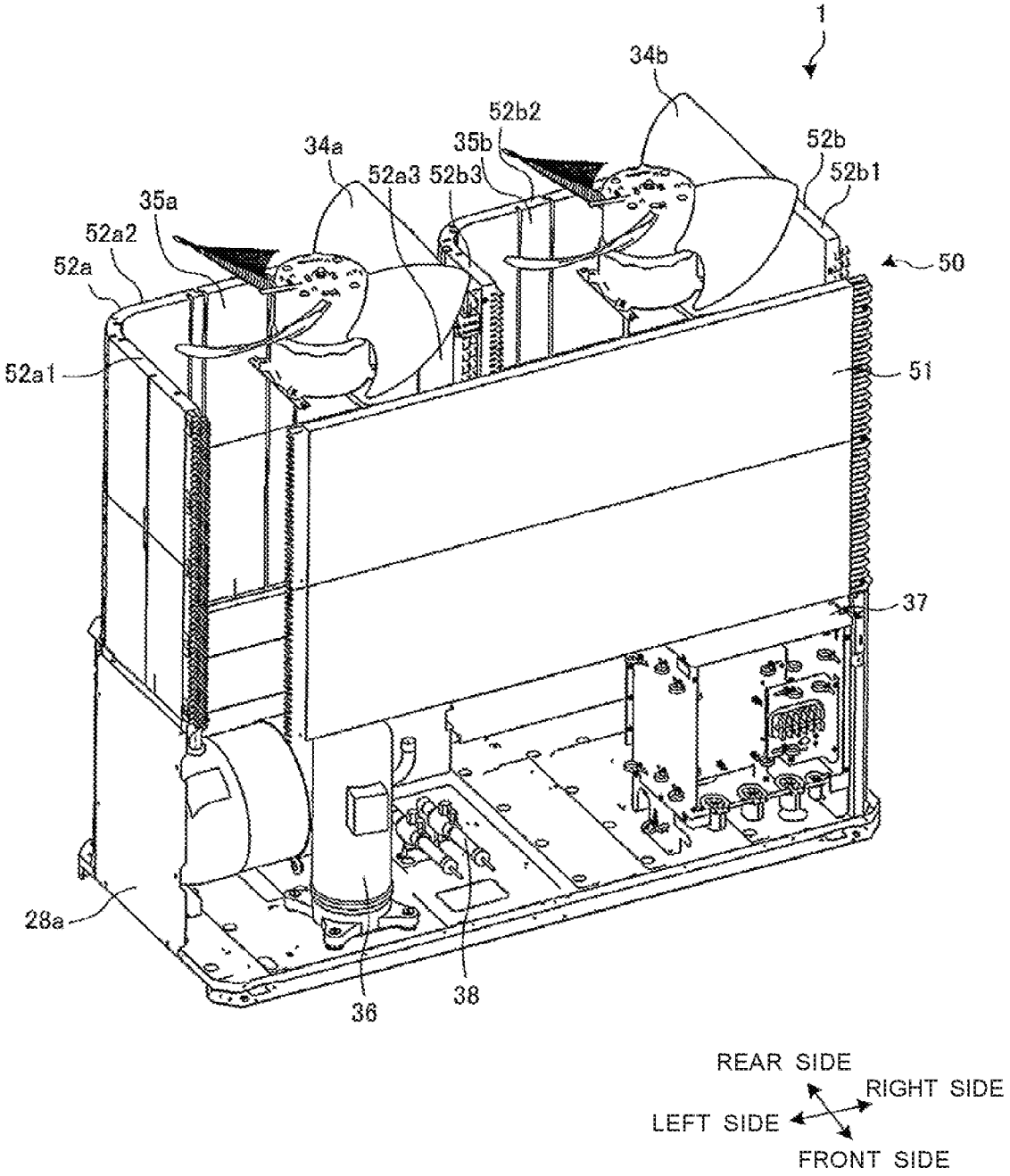
FIG. 2 is a perspective view of the outdoor unit for an air-conditioning apparatus according to Embodiment 1 of the present invention, illustrating an internal configuration thereof.

FIG. 2 is a perspective view of the outdoor unit 1 for an air-conditioning apparatus according to Embodiment 1 of the present invention, illustrating an internal configuration thereof.

As illustrated in FIG. 2, the outdoor unit 1 includes a heat exchanger 50 enclosing air inlet spaces 35*a* and 35*b* provided below the two respective air-sending fans 34*a* and 34*b*. In other words, the two air-sending fans 34*a* and 34*b* are provided above the two respective air inlet spaces 35*a* and 35*b* provided on the inner side of two respective rectangular parts of the heat exchanger 50.

The heat exchanger 50 includes one front heat-exchanger unit 51 and two rear heat-exchanger units 52*a* and 52*b*.

The heat exchanger 50 includes two parts each having a rectangular plan-view shape, with side faces thereof being present inside the casing 11 and on the front side, the left side, the right side, and the rear side, respectively. The two rectangular parts of the heat exchanger 50 enclose the two respective air inlet spaces 35*a* and 35*b*.

The one front heat-exchanger unit 51 has a straight plan-view shape extending along the front portion of the casing 11. That is, the front heat-exchanger unit 51 has a continuous flat plate-like shape positioned on the front side of and extending over the two air inlet spaces 35*a* and 35*b*.

The rear heat-exchanger unit 52*a* is one of the heat exchanger units arranged in the lateral direction of the casing 11 in plan view and each having a U shape having a side face 52*a*1 on the left side, a side face 52*a*3 on the right side, and a side face 52*a*2 on the rear side. The left and right side being continuous with the rear side, the continuous portions being bends of the heat exchanger. The rear heat-exchanger unit 52*b* is one of the heat exchanger units arranged in the lateral direction of the casing 11 in plan view and each having a U shape having a side face 52*b*1 on the left side, a side face 52*b*3 on the right side, and a side face 52*b*2 on the rear side. The left and right side being continuous with the rear side, the continuous portions being bends of the heat exchanger.

Thus, the air inlet spaces 35*a* and 35*b* provided below the two respective air-sending fans 34*a* and 34*b* each have a rectangular plan-view shape enclosed by the respective parts of the heat exchanger 50.

In addition, a compressor 36 and a controller to serve a function of circulating the refrigerant through the outdoor unit 1, and mechanical components such as an electric-device box 37 and pipes 38 are provided below the one front heat-exchanger unit 51 and the two rear heat-exchanger units 52*a* and 52*b*.

Considering the ease of maintenance or attaching of the compressor 36 and the electric-device box 37, the front heat-exchanger unit 51 is positioned above the compressor 36 and the electric-device box 37 so that the compressor 36 and the electric-device box 37 are easily attachable or removable. Therefore, a hollow where the heat exchanger 50 is not present is provided at least at the lower front of the casing 11, whereby a maintenance space for maintaining the mechanical components is provided.

The rear heat-exchanger units 52*a* and 52*b* each have the same vertical size as the front heat-exchanger unit 51 and are each positioned at the same level as the front heat-exchanger unit 51. That is, the rear heat-exchanger units 52*a* and 52*b* are positioned above the compressor 36 and the electric-device box 37, as with the front heat-exchanger unit 51.

Figure 3:
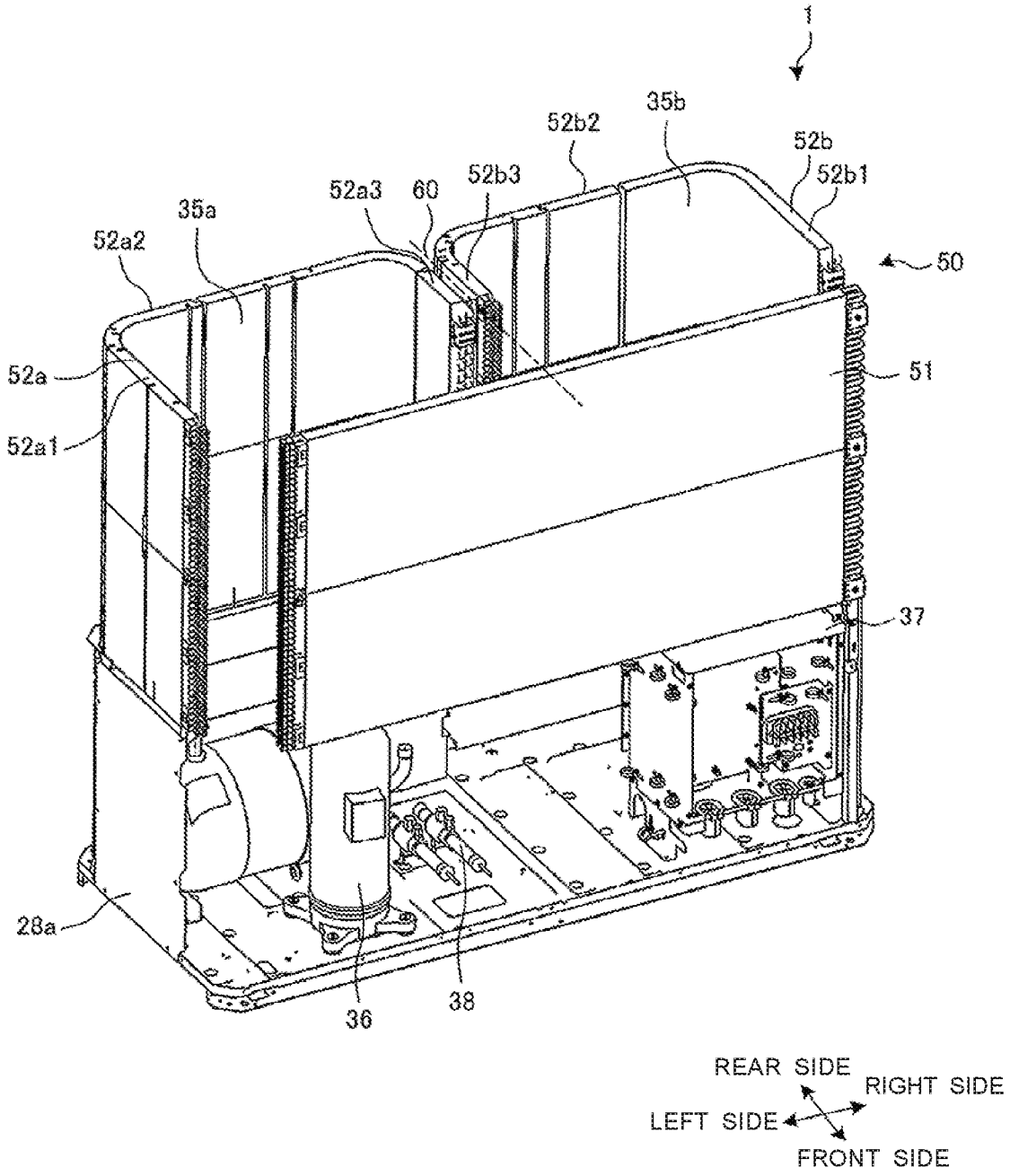
FIG. 3 is a perspective view of one front heat-exchanger unit and two rear heat-exchanger units provided in the outdoor unit for an air-conditioning apparatus according to Embodiment 1 of the present invention, illustrating the arrangement thereof.

FIG. 3 is a perspective view of the one front heat-exchanger unit 51 and the two rear heat-exchanger units 52*a* and 52*b* provided in the outdoor unit 1 for an air-conditioning apparatus according to Embodiment 1 of the present invention, illustrating the arrangement thereof.

As illustrated in FIG. 3, the air inlet spaces 35*a* and 35*b* are enclosed by the one front heat-exchanger unit 51 and the two rear heat-exchanger units 52*a* and 52*b* and each have a rectangular plan-view shape.

The front heat-exchanger unit 51 having a straight shape and is present on the front side of the air inlet spaces 35*a* and 35*b*.

The U-shaped rear heat-exchanger unit 52*a* is present on the left side, the right side, and the rear side of the air inlet space 35*a*. The rear heat-exchanger unit 52*a* has bends continuous to the side faces 52*a*1 and 52*a*3 on the left and right sides, and the side face 52*a*2 on the rear side.

The U-shaped rear heat-exchanger unit 52*b* is present on the left side, the right side, and the rear side of the air inlet space 35*b*. The rear heat-exchanger unit 52*b* has bends continuous to the side faces 52*b*1 and 52*b*3 on the left and right sides, and the side face 52*b*2 on the rear side.

The two rear heat-exchanger units 52*a* and 52*b* are shaped line symmetrically with respect to a center line 60 passing through the center between the left portion and the right portion of the casing 11.

The front heat-exchanger unit 51 has a flat plate-like shape. Therefore, when the front side of the outdoor unit 1 for an air-conditioning apparatus is desired to be opened at the time of maintenance or in any other like situation, the front heat-exchanger unit 51 is easily attachable or detachable.

The front heat-exchanger unit 51 provided on the front side of the casing 11 is positioned closer, than to other, to the right side of the casing 11. Therefore, an open space extending vertically is provided on the front side of the casing 11 and on a side opposite the side with which the front heat-exchanger unit 51 is aligned, that is, between the front heat-exchanger unit 51 and the rear heat-exchanger unit 52*a*.

Figure 4:
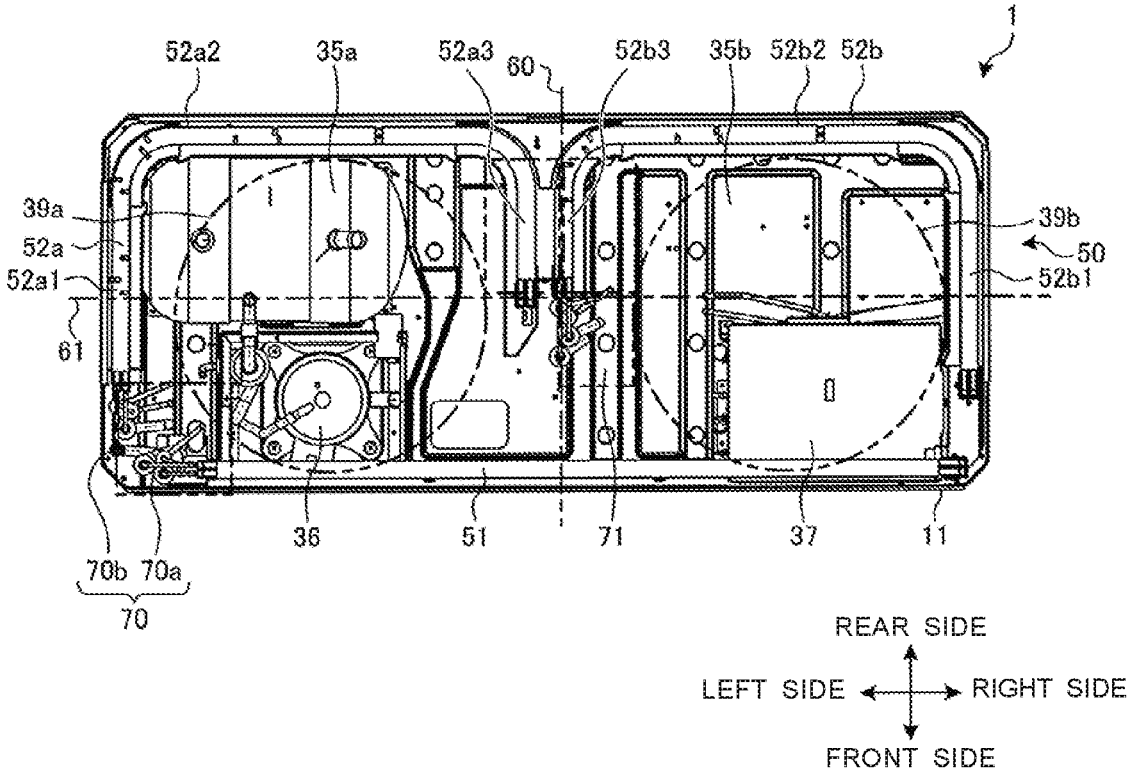
FIG. 4 is a top view of the one front heat-exchanger unit and the two rear heat-exchanger units provided in the outdoor unit for an air-conditioning apparatus according to Embodiment 1 of the present invention, illustrating the arrangement thereof.

FIG. 4 is a top view of the one front heat-exchanger unit 51 and the two rear heat-exchanger units 52*a* and 52*b* provided in the outdoor unit 1 for an air-conditioning apparatus according to Embodiment 1 of the present invention, illustrating the arrangement thereof.

As illustrated in FIG. 4, the front heat-exchanger unit 51 and the rear heat-exchanger units 52*a* and 52*b* are arranged to form rectangular plan-view shapes extending along respective fan top-view contours 39*a* and 39*b*. In other words, the air inlet spaces 35*a* and 35*b* each have a rectangular plan-view shape along the respective fan top-view contours 39*a* and 39*b*.

In the heat exchanger 50 forming the sides enclosing the air inlet spaces 35*a* and 35*b* provided below the two respective air-sending fans 34*a* and 34*b*, the side faces 52*a*3 and 52*b*3 of the respective rear heat-exchanger units 52*a* and 52*b* that are present in a laterally central area of the casing 11 each have a smaller width than the other side faces 52*a*1, 52*a*2, 52*b*1, and 52*b*2. The widths of the side faces 52*a*3 and 52*b*3 of the rear heat-exchanger units 52*a* and 52*b* that are present in the central area are each an effective length by which the side faces 52*a*3 and 52*b*3 are made to extend frontward for maximizing the volume of air to be fed to the heat exchanger 50. The widths of the side faces 52*a*3 and 52*b*3 of the rear heat-exchanger units 52*a* and 52*b* that are present in the central area are equal. The side faces 52*a*3 and 52*b*3 of the rear heat-exchanger units 52*a* and 52*b* that are present in the central area may preferably extend by such a length as to reach a center line 61 in the depth direction of the casing 11.

On the front side of the casing 11, a pipe-connecting area 70*a* where the front heat-exchanger unit 51 is connected to a pipe included in a refrigerant circuit is provided on the side opposite the right side with which the front heat-exchanger unit 51 is aligned.

Furthermore, a pipe-connecting area 70*b* where one of the two rear heat-exchanger units 52*a* and 52*b*, specifically, the rear heat-exchanger unit 52*a*, is connected to a pipe included in the refrigerant circuit is provided on the left side of the casing 11 and adjacent to the pipe-connecting area 70*a* for the front heat-exchanger unit 51.

The pipe-connecting area 70*a* and the pipe-connecting area 70*b* are provided adjacent to each other, thereby forming a pipe-connecting area 70 for the front heat-exchanger unit 51 and the rear heat-exchanger unit 52*a*. The pipe-connecting area 70 is provided in an open space at the front left, considering the ease of maintenance and attaching.

The pipe-connecting area 70 may alternatively be provided at the front right with the front heat-exchanger unit 51 positioned closer, than to other, to the left side. In that case, the pipe-connecting area provided in an open space serves as a pipe-connecting area for the front heat-exchanger unit 51 and the rear heat-exchanger unit 52*a*.

A pipe-connecting area 71 where the other of the two rear heat-exchanger units 52*a* and 52*b*, specifically, the rear heat-exchanger unit 52*b*, is connected to a pipe included in the refrigerant circuit is provided in the laterally central area of the casing 11. The pipe-connecting area 71 for the rear heat-exchanger unit 52*b* is provided in the central area and on the front side with respect to the center line 61 in the depth direction of the casing 11, so that the pipe can be maintained and connected by being accessed from the lower front of the casing 11. The pipe-connecting area 71 for the rear heat-exchanger unit 52*b* is not provided on the right side of the casing 11, because the electric-device box 37 is obstructive, and the length of the pipe to be led from the compressor 36 becomes long.

The position of the pipe-connecting area 71 may be on the rear side with respect to the center line 61 in the depth direction of the casing 11, as long as the pipes are maintainable and connectable.

Figure 5:
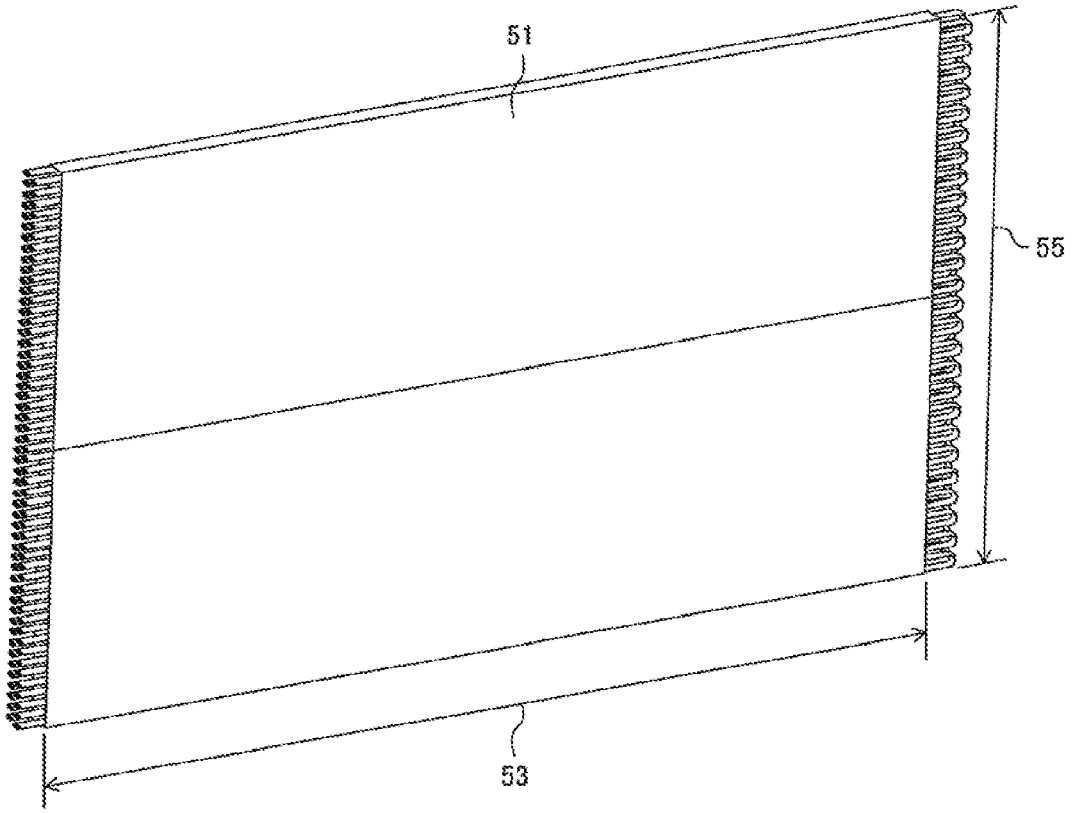
FIG. 5 is a perspective view of the front heat-exchanger unit provided at the front of the outdoor unit for an air-conditioning apparatus according to Embodiment 1 of the present invention.
Figure 6:
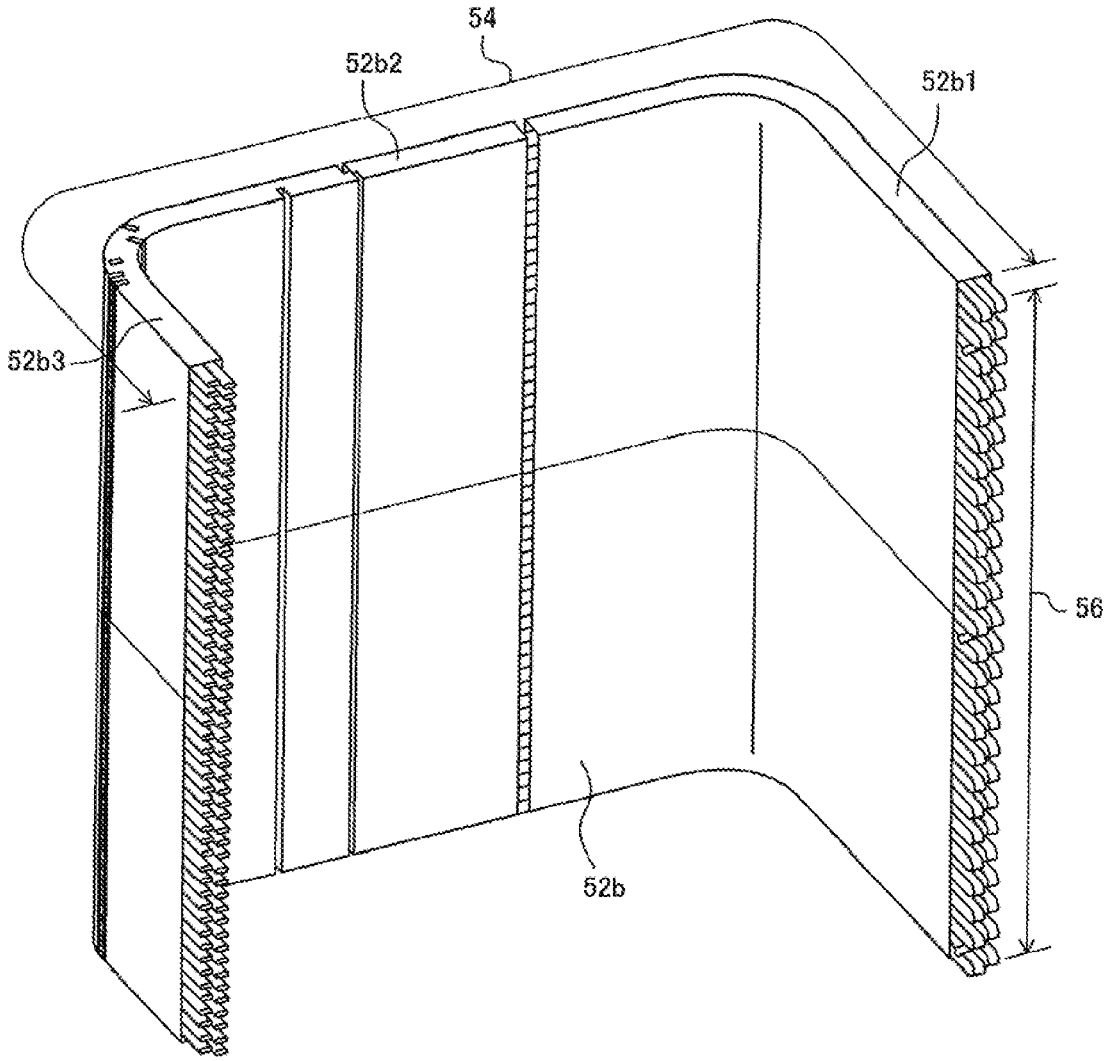
FIG. 6 is a perspective view of the rear heat-exchanger unit provided at the rear of the outdoor unit for an air-conditioning apparatus according to Embodiment 1 of the present invention.

FIG. 5 is a perspective view of the front heat-exchanger unit 51 provided at the front of the outdoor unit 1 for an air-conditioning apparatus according to Embodiment 1 of the present invention. FIG. 6 is a perspective view of the rear heat-exchanger unit 52*b* provided at the rear of the outdoor unit 1 for an air-conditioning apparatus according to Embodiment 1 of the present invention.

The one front heat-exchanger unit 51 and the two rear heat-exchanger units 52*a* and 52*b* all have the same configuration. Specifically, the two rear heat-exchanger units 52*a* and 52*b* are have bends at two positions of the flat front heat-exchanger unit 51. That is, a width 53 of the front heat-exchanger unit 51 is equal to a peripheral length 54 that is the sum of the widths of the side faces 52*a*1, 52*a*2, and 52*a*3 or the side faces 52*b*1, 52*b*2, and 52*b*3 of a corresponding one of the two folded rear heat-exchanger units 52*a* and 52*b*. A vertical length 55 of the front heat-exchanger unit 51 is equal to a vertical length 56 of each of the two rear heat-exchanger units 52*a* and 52*b*. Other factors, such as the thickness, the shape and the number of fins, and the shape and the number of heat-exchanger tubes, are also the same for all of the front heat-exchanger unit 51 and the two rear heat-exchanger units 52*a* and 52*b*.

Thus, the one front heat-exchanger unit 51 and the two rear heat-exchanger units 52*a* and 52*b* are formed of heat-exchanger units of the same configuration and are therefore manufacturable through a common manufacturing process, leading to an improvement in productivity. The one front heat-exchanger unit 51 and the two rear heat-exchanger units 52*a* and 52*b* also have the same capacity. Therefore, the distribution of refrigerant circulated therethrough is kept even. Consequently, the refrigerant circuit can be designed with no consideration for the occurrence of drift currents of the refrigerant.

Advantageous Effects

According to Embodiment 1, the four sides, that is, the front portion, the left portion, the right portion, and the rear portion, of the casing 11 having a rectangular plan-view shape are covered by the heat exchanger 50, and the rear heat-exchanger units 52*a* and 52*b* include the respective side faces 52*a*3 and 52*b*3 in the central area of the casing 11 between the left portion and the right portion. Hence, the side faces of the heat exchanger 50 to which air is to be fed are present along the four respective sides of each of the two air inlet spaces 35*a* and 35*b* each having a rectangular plan-view shape. Thus, the capacity of the heat exchanger 50 is maximized.

For comparison, in the technique according to Patent Literature 1, two L-shaped heat-exchanger units are arranged along the side faces of the casing. Such an arrangement of the heat-exchanger units tends to be restricted in terms of the width and the depth of the casing. Therefore, the capacity of the heat exchanger cannot be maximized.

According to Embodiment 1, the heat exchanger 50 is present on the four sides of each of the air inlet spaces 35*a* and 35*b*, each having a rectangular plan-view shape, along a corresponding one of the fan top-view contours 39*a* and 39*b* of the two respective air-sending fans 34*a* and 34*b*. Therefore, the volume of air to be fed to the heat exchanger 50 can be maximized.

Specifically, according to Embodiment 1, the outdoor unit 1 for an air-conditioning apparatus includes the casing 11 having a rectangular plan-view shape formed of the front portion, the left portion provided on a side of the front portion, the right portion provided opposite the left portion, and the rear portion provided opposite the front portion. The outdoor unit 1 for an air-conditioning apparatus includes, in the casing 11 thereof, the heat exchanger 50 including two parts each having a rectangular plan-view shape, with the side faces thereof being present on the front side, the left side, the right side, and the rear side, respectively, of the casing 11. The outdoor unit 1 for an air-conditioning apparatus further includes the two air-sending fans 34*a* and 34*b* provided above the two respective air inlet spaces 35*a* and 35*b* provided on the inner side of the two respective rectangular parts of the heat exchanger 50.

In such a configuration, the heat-exchanger units 51, 52*a*, and 52*b* can be arranged such that the heat exchanger 50 has a further increased capacity in a casing of a limited size while the volume of air to be fed to the heat exchanger 50 is maximized.

Furthermore, according to Embodiment 1, the heat exchanger 50 includes one front heat-exchanger unit 51 and two rear heat-exchanger units 52*a* and 52*b*. The one front heat-exchanger unit 51 and the two rear heat-exchanger units 52*a* and 52*b* all have the same capacity.

In such a configuration, since heat-exchanger units of the same capacity are employed, no drift currents occur in the refrigerant flowing in the heat exchanger 50. Accordingly, the refrigerant can be efficiently distributed over the heat exchanger 50, and a simple refrigerant circuit can be realized. Consequently, the product cost can be reduced. Moreover, since the heat-exchanger units of the same kind can be manufactured through a common manufacturing process, productivity can be improved.

For comparison, in the technique according to Patent Literature 2, one U-shaped heat-exchanger unit and one flat heat-exchanger unit are combined, and the two heat-exchanger units have different capacities. Therefore, the technique has a problem in that effective performance cannot be obtained unless the amount of refrigerant to be fed into the U-shaped heat-exchanger unit and the amount of refrigerant to be fed into the flat heat-exchanger unit are well balanced with each other. Such a configuration may require a structure that increases the product cost. For example, a linear expansion valve may need to be added to each of the heat-exchanger units. That is, the product cost cannot be reduced.

According to Embodiment 1, the heat exchanger 50 includes two units that are arranged in parallel in the lateral direction of the casing 11 in plan view. In the heat exchanger 50, the widths of the side faces 52*a*3 and 52*b*3 that are present in the laterally central area of the casing 11 are smaller than the widths of the other side faces 52*a*1, 52*a*2, 52*b*1, and 52*b*2.

In such a configuration, the volume of air to be fed to the heat exchanger 50 can be maximized even with the side faces 52*a*3 and 52*b*3 that are present in the laterally central area of the heat exchanger 50. The widths of the side faces 52*a*3 and 52*b*3 that are present in the laterally central area of the heat exchanger 50 are smaller than the widths of the other side faces. Such a configuration suppresses the increase in the product cost that may occur if the heat exchanger 50 is designed excessively long to extend into an area where no air is fed, making no contribution to the performance. Moreover, the pipe-connecting area 71 can be provided on the front side of the side faces 52*a*3 and 52*b*3 that are present in the laterally central area of the heat exchanger 50. Consequently, the ease of maintenance and attaching can be improved.

According to Embodiment 1, the one front heat-exchanger unit 51 having a straight shape extending along the front portion of the casing 11 in plan view is provided as a heat-exchanger unit. The two rear heat-exchanger units 52*a* and 52*b* are arranged in the lateral direction of the casing 11 in plan view and each having a shape having the side faces 52*a*1, 52*a*2, and 52*a*3 or 52*b*1, 52*b*2, and 52*b*3 on the left side, the right side, and the rear side, respectively, are provided as heat-exchanger units. The left and right side being continuous with the rear side, the continuous portions being bends of the heat exchanger.

In such a configuration, the heat exchanger 50 provided in the casing 11 can have two parts each having a rectangular plan-view shape with the side faces thereof being present on the front side, the left side, the right side, and the rear side, respectively, of the casing 11.

According to Embodiment 1, the two rear heat-exchanger units 52*a* and 52*b* are shaped line symmetrically with respect to the center line 60 passing through the center between the left portion and the right portion of the casing 11.

In such a configuration, the two air-sending fans 34*a* and 34*b* take in the same volume of air. Consequently, the distribution of air that is fed to the heat exchanger 50 does not become uneven, that is, the distribution is balanced between the left side and the right side.

According to Embodiment 1, the front heat-exchanger unit 51 provided on the front side of the casing 11 is positioned closer, than to other, to the right side of the casing 11. On the front side of the casing 11, the pipe-connecting area 70*a* where the front heat-exchanger unit 51 is connected to the pipe included in the refrigerant circuit is provided on the left side opposite the side with which the front heat-exchanger unit 51 is aligned.

In such a configuration, the pipe-connecting area 70*a* for the front heat-exchanger unit 51 can be provided on the front side, not interfering with the mechanical components. Therefore, the worker can work easily, and the ease of maintenance and attaching can be improved.

According to Embodiment 1, the pipe-connecting area 70*b* where one of the two rear heat-exchanger units 52*a* and 52*b*, specifically, the rear heat-exchanger unit 52*a*, is connected to the pipe included in the refrigerant circuit is provided on the left side of the casing 11 and adjacent to the pipe-connecting area 70*a* for the front heat-exchanger unit 51. The pipe-connecting area 71 where the other of the two rear heat-exchanger units 52*a* and 52*b*, specifically, the rear heat-exchanger unit 52*b*, is connected to the pipe included in the refrigerant circuit is provided in the laterally central area of the casing 11.

In such a configuration, the pipe-connecting area 70*b* for the one rear heat-exchanger unit 52*a* can be provided on the front side, not interfering with the mechanical components. Therefore, the worker can work easily, and the ease of maintenance and attaching can be improved. In addition, since the pipe-connecting area 70*b* for the one rear heat-exchanger unit 52*a* is provided adjacent to the pipe-connecting area 70*a* for the front heat-exchanger unit 51, a wide pipe-connecting area 70 is provided. Therefore, the worker can work easily, and the ease of maintenance and attaching can be improved. Furthermore, the pipe-connecting area 71 for the other rear heat-exchanger unit 52*b* is solely provided in the laterally central area of the casing 11. Therefore, a satisfactory work space for the worker is provided. Accordingly, the worker can work easily, and the ease of maintenance and attaching can be improved.

According to Embodiment 1, a maintenance space for maintaining the mechanical components is provided at least at the lower front of the casing 11.

Specifically, the lower end of the front heat-exchanger unit 51 is positioned above the mechanical components such as the compressor 36 and the electric-device box 37, whereby the maintenance space is provided. Therefore, the ease of maintenance and attaching of the mechanical components such as the compressor 36 and the electric-device box 37 is not reduced. Thus, the maintenance space of the maximum size can be provided at the lower front of the heat exchanger 50.

In such a configuration, since the space for maintaining the mechanical components is provided in a space where the heat exchanger 50 is not present, a satisfactory size of a work space is provided for the worker. Therefore, the worker can work easily, and the ease of maintenance and attaching can be improved.

For comparison, in the technique according to Patent Literature 3, pipe areas are concentrated in a front central area of the outdoor unit for an air-conditioning apparatus, and there are not enough room, on the front side, for providing a space for maintaining the mechanical components. Therefore, the ease of maintenance and attaching is reduced.

Embodiment 2

The basic configuration of an outdoor unit 1 for an air-conditioning apparatus according to Embodiment 2 is the same as that of the outdoor unit 1 for an air-conditioning apparatus according to Embodiment 1. Therefore, Embodiment 2 will be described focusing on a difference from Embodiment 1.

The difference between Embodiment 1 and Embodiment 2 is the arrangement of a plurality of heat-exchanger units included in the outdoor unit 1 for an air-conditioning apparatus. In Embodiment 1, three heat-exchanger units 51, 52*a*, and 52*b* are employed. In Embodiment 2, two heat-exchanger units 57*a* and 57*b* are employed.

[Configuration of Outdoor Unit for Air-Conditioning Apparatus]

Figure 7:
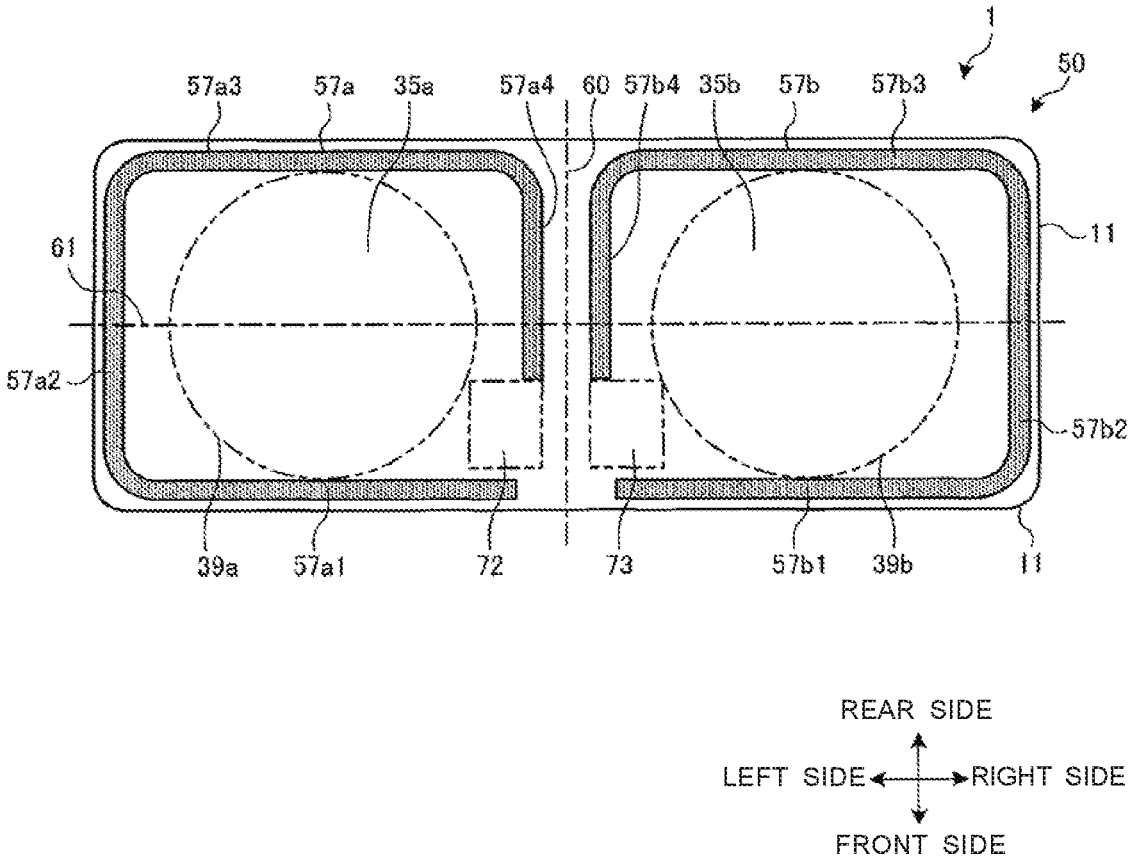
FIG. 7 is a top view of two individual heat-exchanger units provided in an outdoor unit for an air-conditioning apparatus according to Embodiment 2 of the present invention, illustrating the arrangement thereof.

FIG. 7 is a top view of two individual heat-exchanger units 57*a* and 57*b* provided in the outdoor unit 1 for an air-conditioning apparatus according to Embodiment 2 of the present invention, illustrating the arrangement thereof.

The heat exchanger 50 includes the two individual heat-exchanger units 57*a* and 57*b*.

The individual heat-exchanger unit 57*a* is arranged in parallel with the individual heat-exchanger unit 57*b* in the lateral direction of the casing 11 in plan view and having a shape having side faces on the front side, the left side, the right side, and the rear side, respectively. The left and right side being continuous with the rear side, the continuous portions being bends of the heat exchanger. The individual heat-exchanger unit 57*a* has a side face 57*a*1 on the front side, a side face 57*a*2 on the left side, a side face 57*a*4 on the right side, and a side face 57*a*3 on the rear side. The left and right side being continuous with the rear side, the continuous portions being bends of the heat exchanger.

The individual heat-exchanger unit 57*b* is arranged in parallel with the individual heat-exchanger unit 57*a* in the lateral direction of the casing 11 in plan view and having a shape having side faces on the front side, the left side, the right side, and the rear side, respectively. The individual heat-exchanger unit 57*b* has a side face 57*b*1 on the front side, a side face 57*b*2 on the left side, a side face 57*b*4 on the right side, and a side face 57*b*3 on the rear side.

The two individual heat-exchanger units 57*a* and 57*b* are shaped line symmetrically with respect to a center line 60 passing through the center between the left portion and the right portion of the casing 11. The two individual heat-exchanger units 57*a* and 57*b* have the same capacity.

Pipe-connecting areas 72 and 73 where the two individual heat-exchanger units 57*a* and 57*b* are connected to respective pipes included in a refrigerant circuit are provided in a laterally central area of the casing 11. The pipe-connecting areas 72 and 73 for the two individual heat-exchanger units 57*a* and 57*b* are provided on the front side with respect to a center line 61 in the depth direction of the casing 11, so that the pipes can be easily maintained.

Advantageous Effects

According to Embodiment 2, the two individual heat-exchanger units 57*a* and 57*b* are arranged in parallel in the lateral direction of the casing 11 in plan view and respectively having a shape having the side faces 57*a*1, 57*a*2, 57*a*4, and 57*a*3 on the front side, the left side, the right side, and the rear side, respectively, and a shape having side faces 57*b*1, 57*b*2, 57*b*4, and 57*b*3 on the front side, the left side, the right side, and the rear side, respectively, are provided as heat-exchanger units. The left and right sides being continuous with the rear sides, the continuous portions being bends of the heat exchanger.

In such a configuration, the heat exchanger 50 provided in the casing 11 can have two parts each having a rectangular plan-view shape with the side faces thereof being present on the front side, the left side, the right side, and the rear side, respectively, of the casing 11.

According to Embodiment 2, the two individual heat-exchanger units 57*a* and 57*b* are shaped line symmetrically with respect to the center line 60 passing through the center between the left portion and the right portion of the casing 11.

In such a configuration, the two air-sending fans 34*a* and 34*b* take in the same volume of air. Consequently, the distribution of air that is fed to the heat exchanger 50 does not become uneven, that is, the distribution is balanced between the left side and the right side.

According to Embodiment 2, the pipe-connecting areas 72 and 73 where the two individual heat-exchanger units 57*a* and 57*b* are connected to the respective pipes included in the refrigerant circuit are provided in the center between the left portion and the right portion of the casing 11.

In such a configuration, the volume of air to be fed to the heat exchanger 50 can be maximized even with the side faces 57*a*4 and 57*b*4 that are present in the laterally central area of the heat exchanger 50. The widths of the side faces 57*a*4 and 57*b*4 that are present in the laterally central area of the heat exchanger 50 are smaller than the widths of the other side faces. Such a configuration suppresses the increase in the product cost that may occur if the heat exchanger 50 is designed excessively long to extend into an area where no air is fed, making no contribution to the performance. Moreover, the pipe-connecting areas 72 and 73 can be provided on the front side of the side faces 57*a*4 and 57*b*4 that are present in the laterally central area of the heat exchanger 50. Consequently, the ease of maintenance and attaching can be improved.

According to Embodiment 2, the number of individual components can be reduced to two each for the respective heat-exchanger units 57*a* and 57*b*. Therefore, productivity is improved.

While Embodiments 1 and 2 have been described above, the present invention is not limited thereto. For example, all or some of the features of the embodiments may be combined.

While Embodiments 1 and 2 each concern a configuration in which two air-sending fans are provided in one casing, the present invention is not limited to such a configuration. For example, three or more air-sending fans may be provided in parallel in one casing. Furthermore, the heat exchanger may be provided in such a manner as to enclose air inlet spaces provided below the three or more air-sending fans, respectively, and to extend along the four sides of each of the air inlet spaces, whereby the air inlet spaces each have a rectangular plan-view shape.

REFERENCE SIGNS LIST

1 outdoor unit 11 casing 21 left front pillar 22 right front pillar 23 left rear pillar 24 front center pillar 25*a* front frame 26*a* left frame 27*a* lower front panel 27*b* lower front panel 28*a* lower left panel 29*a* top panel 29*b* top panel 32*a* air inlet 32*b* air inlet 33*a* air outlet 33*b* air outlet 34*a* air-sending fan 34*b* air-sending fan 35*a* air inlet space 35*b* air inlet space 36 compressor 37 electric-device box 38 pipe 39*a* fan top-view contour 39*b* fan top-view contour 50 heat exchanger 51 front heat-exchanger unit 52*a* rear heat-exchanger unit 52*a*1 side face 52*a*2 side face 52*a*3 side face 52*b* rear heat-exchanger unit 52*b*1 side face 52*b*2 side face 52*b*3 side face 53 width 54 peripheral length 55 vertical length 56 vertical length 57*a* individual heat-exchanger unit 57*a*1 side face 57*a*2 side face 57*a*3 side face 57*a*4 side face 57*b* individual heat-exchanger unit 57*b*1 side face 57*b*2 side face 57*b*3 side face 57*b*4 side face 60 center line 61 center line 70 pipe-connecting area 70*a* pipe-connecting area 70*b* pipe-connecting area 71 pipe-connecting area 72 pipe-connecting area 73 pipe-connecting area

The invention claimed is:

1. An outdoor unit for an air-conditioning apparatus, the outdoor unit comprising:

a casing having a rectangular plan-view shape formed of a front portion, a left portion provided on a side of the front portion, a right portion provided opposite the left portion, and a rear portion provided opposite the front portion;

heat exchanger assemblies provided in the casing, the heat exchanger assemblies each having a rectangular plan-view shape with side faces being present on a front side, a left side, a right side, and a rear side, respectively, of the casing; and a plurality of air-sending fans provided above a plurality of air inlet spaces, respectively, the air inlet spaces each being provided on an inner side of a corresponding one of the heat exchanger assemblies, wherein the heat exchanger assemblies each comprise a plurality of heat exchangers comprising one heat exchanger having a straight plan-view shape and two heat exchangers each having a U-shape having bends in a plan view.

2. The outdoor unit for an air-conditioning apparatus of claim 1, wherein the heat exchanger assemblies each include a plurality of heat exchangers, and wherein each of the plurality of heat exchangers have a same capacity.

3. The outdoor unit for an air-conditioning apparatus of claim 1, wherein the heat exchanger assemblies comprise two heat exchanger assemblies that are arranged in parallel in a lateral direction of the casing in plan view, and widths of the side faces that are present in a laterally central area of the casing are smaller than widths of the other side faces.

4. The outdoor unit for an air-conditioning apparatus of claim 2, wherein the plurality of heat exchangers comprise one front heat exchanger having a straight plan-view shape extending along the front portion of the casing, and two rear heat exchangers arranged in a lateral direction of the casing in plan view and each having a shape having side faces on a left side, a right side, and a rear side, the left side and right side being continuous with the rear side and being bends of the heat exchanger assemblies.

5. The outdoor unit for an air-conditioning apparatus of claim 4, wherein the two rear heat exchangers are shaped line symmetrically with respect to a center line passing through a center between the left portion and the right portion of the casing.

6. The outdoor unit for an air-conditioning apparatus of claim 4, wherein the front heat exchanger in one of the heat exchanger assemblies is provided on the front side of the casing is positioned closer to one lateral side than a front heat exchanger in another one of the heat exchanger assemblies, and wherein a pipe-connecting area where the front heat exchanger is connected to a pipe included in a refrigerant circuit is provided on the front side of the casing and on the other lateral side.

7. The outdoor unit for an air-conditioning apparatus of claim 6, wherein a pipe-connecting area where one of the two rear heat exchangers is connected to a pipe included in the refrigerant circuit is provided on one of the left side and the right side of the casing and adjacent to the pipe-connecting area for the front heat exchanger, and wherein a pipe-connecting area where an other of the two rear heat exchangers is connected to a pipe included in the refrigerant circuit is provided in a laterally central area of the casing.

8. The outdoor unit for an air-conditioning apparatus of claim 2, wherein the plurality of heat exchangers comprise two individual heat exchangers arranged in parallel in a lateral direction of the casing in plan view and each having a shape having side faces on a front side, a left side, a right side, and a rear side, the left side and right side being continuous with the rear side and being bends of the heat exchanger assemblies.

9. The outdoor unit for an air-conditioning apparatus of claim 8, wherein the two individual heat exchangers are shaped line symmetrically with respect to a center line passing through a center between the left portion and the right portion of the casing.

10. The outdoor unit for an air-conditioning apparatus of claim 8, wherein a pipe-connecting area where the two individual heat exchangers are connected to respective pipes included in a refrigerant circuit is provided in a center between the left portion and the right portion of the casing.

11. The outdoor unit for an air-conditioning apparatus of claim 1, wherein a maintenance space for maintaining a mechanical component is provided at least in a lower front part of the casing.

12. The outdoor unit of claim 1, wherein a storage chamber in which mechanical components are stored is provided below the heat exchanger assemblies.

* * * * *